US006555177B1

(12) United States Patent
Magnusson et al.

(10) Patent No.: US 6,555,177 B1
(45) Date of Patent: Apr. 29, 2003

(54) CERAMIC-BASED HARDWOOD FLOOR FINISHING METHOD

(76) Inventors: Tryggvi Magnusson, 1010 Everest Blvd., Wausau, WI (US) 54403; Guenther Pollak, 4301 North Lake Shore Dr., Wausau, WI (US) 54401

( * ) Notice: Subject to any disclaimer, the term of this patent is extended or adjusted under 35 U.S.C. 154(b) by 0 days.

(21) Appl. No.: 09/678,553

(22) Filed: Oct. 4, 2000

(51) Int. Cl.[7] ..... B05D 1/38; B05D 3/00; B05D 1/40; B24B 1/00

(52) U.S. Cl. ..... 427/408; 427/384; 427/407.1; 524/80; 524/914

(58) Field of Search ..... 427/407.1, 203, 427/205, 204, 408, 384; 524/80, 81, 475, 914

(56) References Cited

U.S. PATENT DOCUMENTS 4,662,972 A * 5/1987 Thompson ..... 156/279
4,735,659 A * 4/1988 Bishop ..... 106/193 R
5,445,670 A * 8/1995 Each et al. ..... 106/3
5,709,589 A * 1/1998 Boone ..... 451/54
5,783,303 A * 7/1998 Tsuei ..... 428/354
6,228,463 B1 * 5/2001 Chen et al. ..... 428/160

* cited by examiner

*Primary Examiner*—Michael Barr
*Assistant Examiner*—Elena Tsoy
(74) *Attorney, Agent, or Firm*—Boyle Fredrickson Newholm Stein & Gratz S.C.

(57) ABSTRACT

A ceramic-based hardwood floor finishing method resistant to panelization, exhibiting improved durability, and suitable for on-site use. The method is comprised of laying down successive layers of water-based primer, armor coat and top coat. The water-based primer utilizes a low resin content and a low co-solvent concentration to substantially reduce panelization of hardwood boards. The water-based armor coat is comprised of large particulate size ceramic additives which, in combination with a low resin content, allow the formation of a microscopic bead structure on the surface of the finish which provides enhanced durability.

18 Claims, 4 Drawing Sheets

CERAMIC-BASED HARDWOOD FLOOR FINISHING METHOD

FIELD OF THE INVENTION

The invention relates to water-based hardwood floor finishing products and methods of applying the products on site.

BACKGROUND OF THE INVENTION

Hardwood flooring has long enjoyed favor with consumers due to the unique richness and elegance that it adds to a home or business setting. Although hardwood flooring is a consumer favorite, inherent physical characteristics of hardwood flooring make it susceptible to damage from ordinary usage and the occasional accident. As such, it has become traditional practice in the flooring industry to protect hardwood floors with some form of coating or finish to preserve aesthetic qualities, and ultimately extend the useful life of the surface.

Many protective finishes are known in the flooring industry. Protective finishes in the prior art include varnishes, acrylics, urethanes, and epoxies or combinations thereof. In general, protective finishes are applied to hardwood surfaces in successive layers, with each layer performing a specific purpose. For example, a protective finish normally constitutes primers applied directly to the hardwood surface to bond and seal the porous wood itself and top coat layers applied over the sealing layers to provide sheen and stain resistance. In recent years, water-based finishes (i.e., solutions in which water is the primary solvent) have become popular due to environmental and health concerns. In addition, various layers may also contain additives including co-solvents, defoamers, flow additives and wax emulsions to provide ease of application and improve the overall effectiveness of the protective finish.

Although the above-mentioned primers and top coats provide some protection against mechanical damage due to scratching, gouging, scuffing or the like, the hardwood flooring industry has invested much time and effort into identifying further additives for floor finishes in order to improve the overall durability of hardwood floor surfaces. Unfortunately, increasing finish durability often results in a finish with reduced abilities to preserve aesthetic qualities. Thus, the fine balance between durability and preservation of desirable characteristics such as clarity is difficult to attain. Nonetheless, such finishes are extremely desirable.

Finished hardwood floors also suffer from a problem termed panelization. Panelization, to be more thoroughly discussed below, results when resins contained in the primer coat invade the gaps between hardwood boards, cross-link, and cause neighboring boards to become rigidly affixed to each other as if glued together. Unfortunately, when hardwood boards contract due to seasonal changes in humidity, large sections of panelized flooring contract to leave unsightly, uneven gaps at the boundaries of the panelized units. Without panelization, the gaps between boards would be evenly distributed, and hence smaller and less noticeable throughout seasonal humidity cycles. A method of finishing hardwood floors that avoids this problem, but provides durability and is aesthetically pleasing, is needed.

BRIEF SUMMARY OF THE INVENTION

The invention is a hardwood floor finishing method that uses water-based coatings and exhibits improved durability during ordinary usage and against accidental damage. It also substantially reduces or eliminates the above mentioned panelization problem. In general, the finishing method is intended to be carried out on-site in several simple, efficient and safe steps. In its preferred form, the method involves the application of a ceramic-based armor coat over the primer layers in order to improve the durability and wearability of the floor finish.

The inventive method disclosed herein is preferably implemented on a new floor by applying successive layers of primer, ceramic armor and top coat to a newly screened, cleaned and tacked hardwood surface. The primer is a water-based primer having a low solid content and low co-solvent concentration in order to reduce or eliminate panelization. As with many conventional primers, the primer contains a mixture of acrylic and polyurethane polymer resin dispersions that are not water-soluble, but are suspended in the water/co-solvent mixture. Alternatively, the primer may be a copolymer substitute for the acrylic and polyurethane mixture. Upon application to the prepared surface, this water-based primer penetrates the pores of the hardwood and acts to thoroughly seal the exposed hardwood surface. Use of a water-based primer to seal a hardwood surface is widely known in the field. However, as mentioned, the method disclosed herein involves applying a water-based primer having an unusually low resin content and low co-solvent concentration. It is believed that the combination of the low resin content and a low co-solvent concentration reduces the flow of resins into the gaps between the hardwood boards during the initial drying process. A second coating of primer is applied after initial drying of the first primer coat. Two coats of primer are needed because the coats are thin. The problem posed by panelization of hardwood floor boards is substantially eliminated by using a thin coating of low solid content/low co-solvent concentration primer, but a sufficient primer build is obtained by using two coats of primer.

It has been found that panelization results from the use of primers having a high solid content of polymers or copolymer resins and a high concentration of co-solvent. This combination promotes not only the flow of uncrosslinked polymer or copolymer resins into the existing gap between new hardwood boards but also the subsequent solvation step necessary to cross link the resins. However, the polymer or copolymer resins remain uncrosslinked when in a solution having a high water content. Only when water is removed as by evaporation, are the polymer or copolymer resins solved into the increasing concentration of co-solvent. Once solved, the polymer or copolymer resin crosslink into a rigid composition potentially resulting in a group of boards being joined or glued together to form a panel-like unit. It should be noted that hardwood normally contracts in a direction across the grain, and therefore the width of the boards normally shrinks when the hardwood boards respond to seasonal changes in humidity. The unfortunate result of this phenomenon on a panelized floor is that gap width is consequently spread unevenly across the floor surface. Instead of small gaps of uniform width existing between each new hardwood board, a panelized group of boards will have essentially no gaps on its interior, but much larger and noticeable gaps will surround the panel. The gaps due to panelization are especially evident during the winter when humidity is relatively low. These noticeable gaps in the hardwood surface are obviously undesirable.

The low concentration of acrylic and polyurethane polymer resins or copolymer resins in the primer effectively reduces the concentration of uncrosslinked resin in the gap area when the primer is first applied. Subsequently, the concentration of the crosslinked resins in the gap area remains relatively low for an extended time period because the water within the gaps takes longer to evaporate than on the hardwood boards' exposed surfaces. Thus, if a second layer of primer is applied within a certain amount of time (e.g. about 45 minutes), the gap area between hardwood boards remains relatively free of cured resins.

After the primer layers are dry, the floor is then screened, vacuumed and tacked with a dampened cloth to remove all dust particles. Then, within about two to three hours of applying the second primer coat, the armor coat is applied to the floor. The armor coat effectively seals over the gap which should at this time still contains the primer solution with a relatively high concentration of water. The primer solution in the gap area is consequently left undried. In this manner, the resins in the armor coat are not allowed to reside deep within the gaps. Rather, as the armor coating dries, it forms a relatively thin bridge across the gap between the boards. Within twenty-four hours, the top coat should be applied over the armor coat. When the top coat and the armor coat continue to dry and cure over time, the coats shrink and the thin bridging across the gaps cracks easily. Also, the high content of water contained within the sealed off gap area is slowly absorbed into the porous walls of the neighboring hardwood boards. Left behind is a small amount of crosslinked resin which does not act as glue between hardwood boards. The gap area will ultimately be completely open and each hardwood board may expand and contract independently of their neighbor. In sum, individual hardwood boards do not become rigidly attached to each other and the unsightly effects of panelization are greatly reduced or eliminated totally.

The preceding paragraphs discuss the method for finishing newly constructed hardwood floors. However, when finishing older hardwood floors, panelization, if it is going to occur, will have probably already occurred. Thus, there is no advantage in applying a primer layer with panelization-inhibiting abilities to older hardwood floors that have previously been finished. Thus, the preferred method of finishing an older hardwood surface involves buffing the old finish and applying the armor coat and top coat directly on the buffed surface. Alternatively, the existing finish can be removed by sanding and a traditional high solid content primer can be applied in order to provide a sufficient build on the surface. High solid content primers, as noted previously, are widely known in the field.

In addition to offering a remedy for panelization problems, the preferred embodiment of the invention also provides an approach to improving the durability of the hardwood floor coating. The use of ceramic additives (e.g. aluminum oxide) to provide abrasion resistance and durability in floor finishes has been widely discussed in the prior art. Normally, the aluminum oxide particles are relatively small and embedded into the cured resin. In the preferred embodiment of the invention, however, relatively large-sized ceramic particles are mixed into the water-based armor coat. Also, the armor coat has a low resin content. This provides the fully cured finish with a unique microscopic bead structure on its surface. Standard abrasion resistance testing has shown that the microscopic bead structure provides a finished hardwood floor with extremely high durability.

More specifically, the diameter of the large particles of ceramic additive (e.g., aluminum oxide) are preferably in the range of 15 to 35 microns. When the armor coat is applied over the panelization-reducing primer layer(s), a large percentage of the non-ceramic components (i.e. water and co-solvent) in-the armor coat evaporate completely. The components left behind, namely the crosslinked acrylic and polyurethane polymers (or copolymers), produce a thin layer of hardened resin in which the larger ceramic particles remain protruding above. These protrusions are termed microbeads. The microbeads on the surface of top coat layer remain even after subsequent applications of a water-based top coat layer over the heterogeneous armor coat layer. An incidental benefit of the microbeaded top coat surface is the anti-slip characteristics bestowed on the surface due to the increased frictional coefficient of the microbeaded top coat layer.

It should be apparent to those skilled in the art that the invention provides a practical and simple hardwood floor finishing method that yields a finish resistant to the problems of panelization. In another aspect, it should also be apparent that the finish is convenient to apply on-site and also provides exceptional durability. The finishing method is easy to apply on-site to both newly constructed hardwood floors and old hardwood floors in need of refinishing. In addition, the invention provides an environmentally safe method that generates no noxious fumes and contains no caustic agents. It is safe for both the people that work with the system and the environment in general.

Various other features, objects, and advantages of the invention will be made apparent from the following detailed description and the drawings.

DETAILED DESCRIPTION OF THE INVENTION

In general, the inventive method involves successive application of a water-based primer to form a primer layer, a water-based armor coat to form an armor coat layer, and a water-based top coat to form a top coat layer. The preferred process for a newly constructed hardwood floor surface is different than the preferred process for an old floor being refinished.

Figure 1:
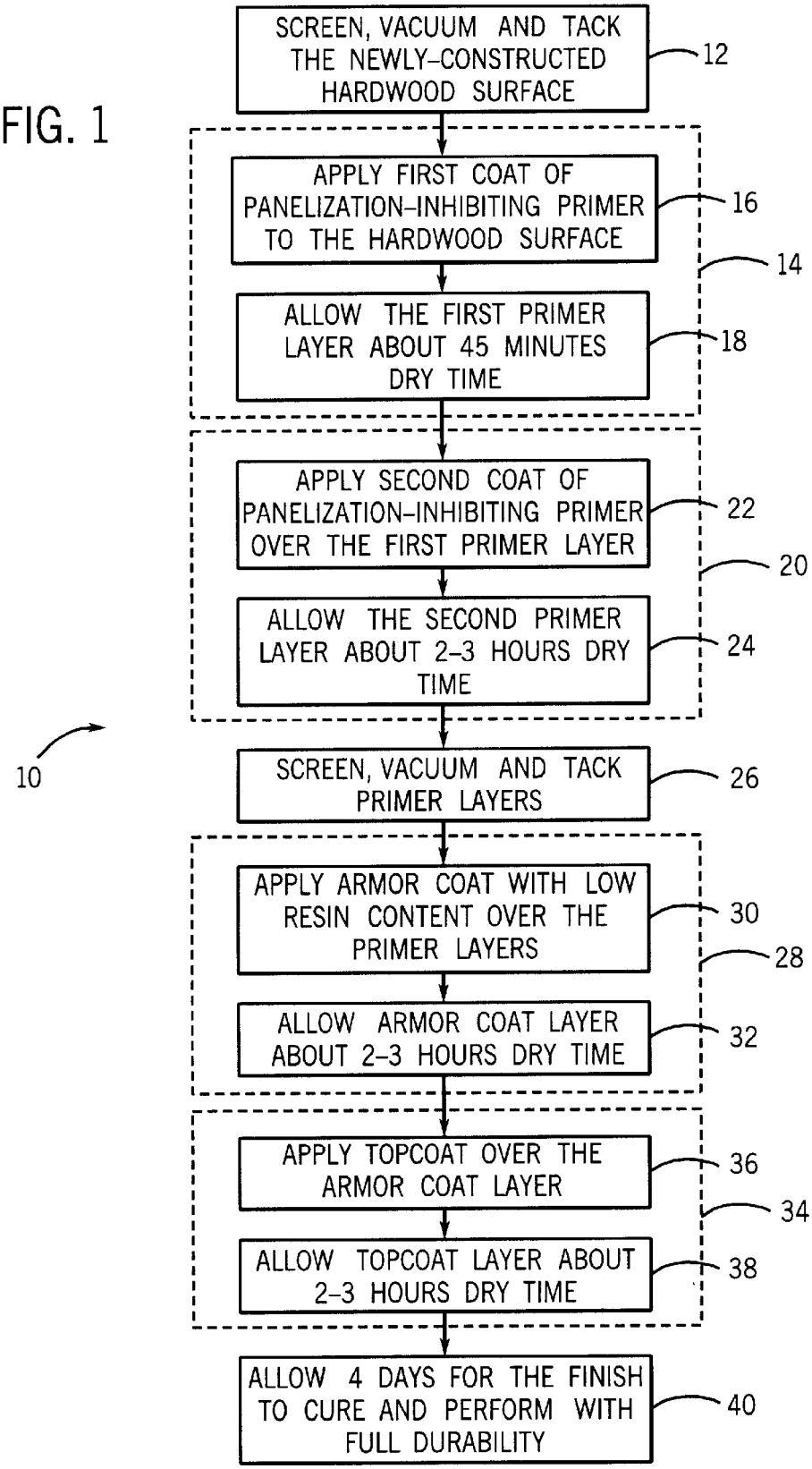
FIG. 1 is a flowchart illustrating the preferred process for the finishing method for a newly constructed hardwood floor surface in accordance with the invention.

FIG. 1 is a flowchart illustrating the preferred steps of the inventive finishing process 10 as applied to a newly constructed hardwood surface. Prior to applying the first primer coat, block 14, the hardwood surface is screened, block 12. For neutral or stained floors, the screening should be to a final 80–100 grit. For unstained, natural floors, the final screening should be to a 120–150 grit. Initial screening provides a relatively smooth surface for subsequent application of the finish layers, and also removes irregularities on the hardwood surface which can create breaks in the hardened finish. Following screening, the hardwood surface is thoroughly vacuumed to remove particulate matter. As a final preparatory step, the hardwood surface is tacked with a water dampened cloth to remove any remaining particulate matter and to provide a water-dampened surface to promote the subsequent successful application of a water-based primer, block 14.

A first coat of water-based primer is applied to the prepared hardwood surface, block 16. The water-based primer is a panelization-inhibiting primer characterized by a low solid content and a low co-solvent concentration. The panelization inhibiting primer is applied directly to the hardwood surface and preferably contains a mixture of self cross-linking acrylic/polyurethane dispersions (or a suitable copolymer), a co-solvent, a flow additive, and a wax emulsion. The preferred panelization-inhibiting primer may be comprised of about 15 percent up to about 20 percent by weight of a mixture of acrylic and polyurethane polymers and about 0.2 percent up to about 1.5 percent by weight of at least one co-solvent. The preferred embodiment of the water-based primer contains 16 percent by weight of a mixture of acrylic and polyurethane polymers and 1 percent by weight of co-solvent.

The preferred acrylic dispersion is a pure acrylic dispersion or a styrene acrylic dispersion. The preferred polyurethane dispersion is based on aliphatic or aromatic polyisocyanates. The mixture is preferably 1 to 1½ parts acrylic to 1 part polyurethane (by weight), although pure polyurethane may be used if desired. The preferred co-solvent is N-methylpyrrolidone. Traditional water-based primers/sealants regularly contain between 3 and 10 percent by weight co-solvent. The reduction in co-solvent concentration to 1 percent by weight provides a substantial increase in the ability of the finish to resist panelization. The preferred embodiment also includes a polyalkylene wax emulsion, namely, a polyethylene wax emulsion.

In this embodiment, it is desirable to repeat the application of the panelization-inhibiting primer such that two successive primer layers are formed, block 20. After allowing 45 minutes for the first primer layer to dry, block 18, the panelization-inhibiting primer is again applied to create a second primer layer, block 22. After 2–3 hours drying time, block 24, the surface of the second primer layer is screened, vacuumed and tacked, block 26, to prepare for the application of the water-based armor coat, block 28.

A water-based armor coat is applied over the screened primer layer, block 30, and allowed 2–3 hours to dry, block 32. The water-based armor coat has a low resin content and is comprised of only 15 percent up to about 25 percent by weight of a mixture of acrylic and polyurethane polymers (or suitable copolymer).

The preferred polymer mixture is the same as described above with respect to the primer. However, a concentration of 17 percent by weight is preferred in the armor coat. The armor coat includes a low concentration of co-solvent in the range of 5 percent up to about 12 percent by weight with a concentration of 5.8 percent by weight being preferred. The armor coat also comprises about 25 percent up to about 35 percent by weight of at least one ceramic additive having an average particle size (diameter) in the range of about 15 microns to about 35 microns, about 0.2 percent up to about 2.0 percent by weight of a fumed silica, and about 1 percent up to about 2 percent by weight of a non-polyethylene wax emulsion. The armor coat may also comprise at least one flow additive. The preferred ceramic additive is aluminum oxide with a particle size (diameter) in the range of about 28 to about 32 microns. The preferred amount of ceramic additive is about 20–30 percent by weight. It should be noted that the surface of the armor coat layer is not screened before a top coat is applied, block 34.

A water-based top coat, block 34, is applied over the armor coat layer, block 28, to form a top coat layer. The water-based top coat, block 36, is preferably a mixture of acrylic and polyurethane polymer (or suitable copolymer), a co-solvent, a flow additive, a polyethylene wax emulsion and a UV stabilizer. The preferred polymer mixture is the same as described above with respect to the primer and the armor coat. However, the concentration of the polymer mixture should be in a range from about 34 to about 42 percent by weight with 39 percent by weight being preferred. The top coat is also characterized by a high content of co-solvent in the range of about 5 percent to about 12 percent with 6.2 percent by weight being preferred. This high concentration of co-solvent promotes even spreading and drying of the top coat. The top coat layer is allowed 2–3 hours to dry, block 38. Although the finish will be dry to the touch at this time, four days should be allowed for the finish to cure completely and perform with full durability, block 40.

Figure 2A:
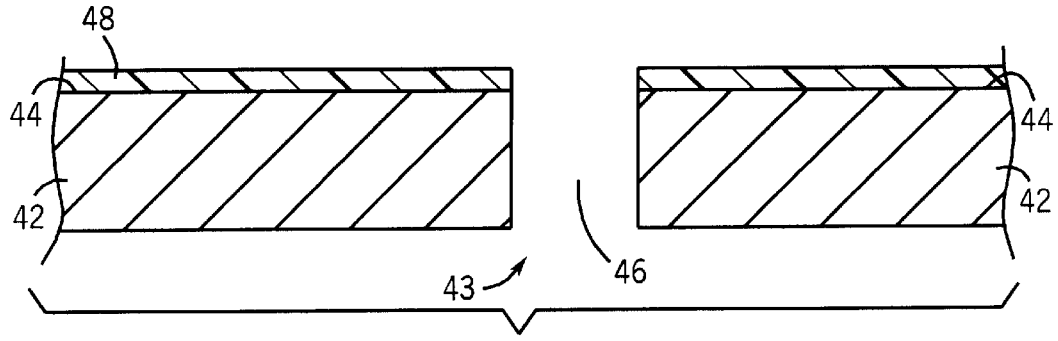
FIGS. 2*a* through 2*e* are schematic views of the specific layers formed during the process described in FIG. 1.
Figure 2B:
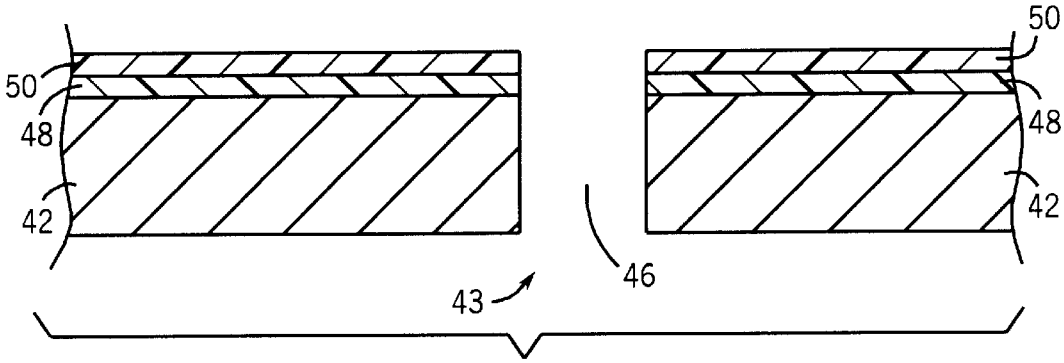
Figure 2C:
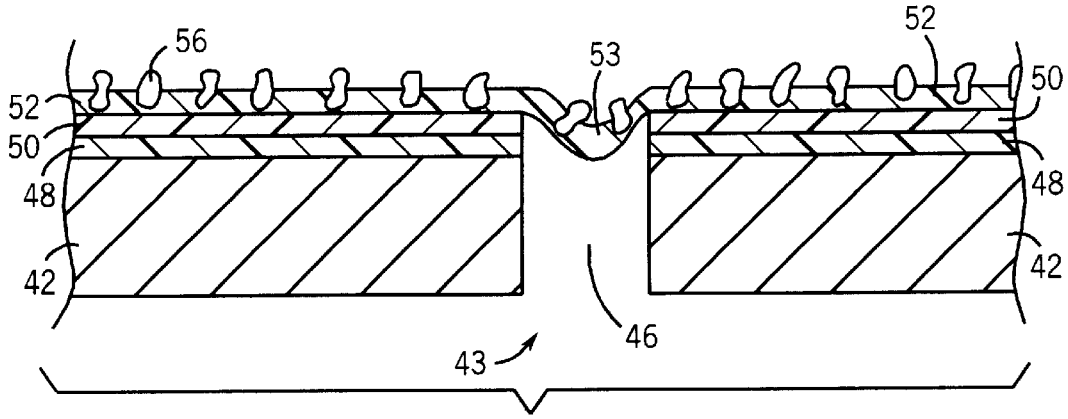
Figure 2D:
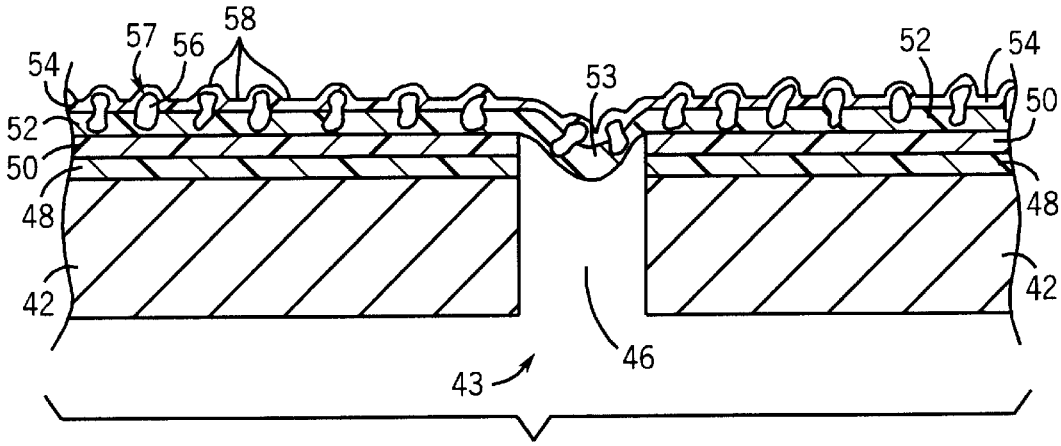
Figure 2E:
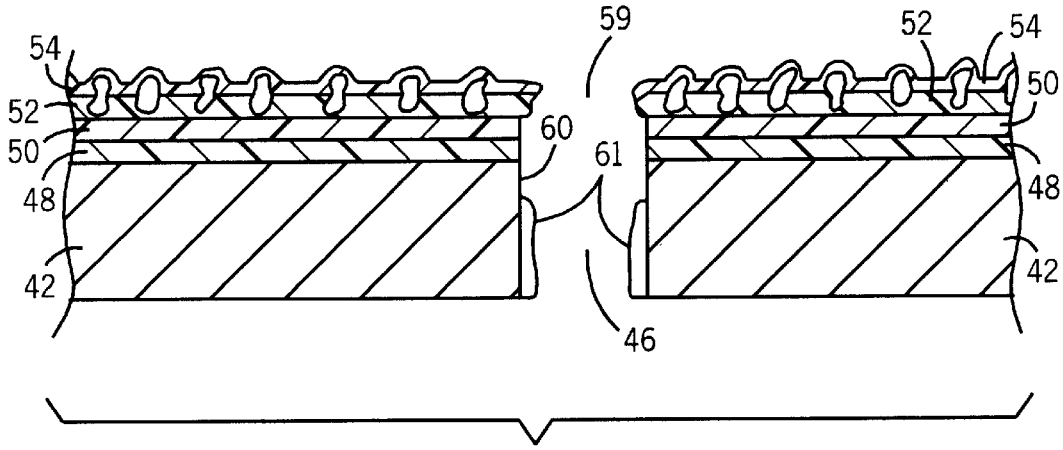

FIGS. 2*a* through 2*e* depict cross-sectional views of two hardwood boards 42, a gap 46 existing between the adjacent hardwood boards 42, and successive layers of coatings formed by the method described above to produce a hardwood floor finish 48–54. FIGS. 2*a*–2*c* represent conditions immediately prior to application of subsequent coats. FIG. 2*d* represents the condition after all coats have been applied, and dried for 2–3 hours. FIG. 2*e* represents the condition of the finish after full curing and seasonal contractions/expansions have occurred.

Referring to FIG. 2*a*, a small gap 46 is inherently created between hardwood boards 42 in the construction of hardwood floors. The first primer layer 48 is formed directly over the hardwood board surfaces 44 by application of the panelization-inhibiting primer. Panelization-inhibiting primer in the gap area 43 remains uncrosslinked due to the reduced evaporative characteristics of the gap area 46. Referring to FIG. 2*b*, a second primer layer 50 is applied over the top of the first primer layer 48. An armor coat layer 52 is then subsequently formed over the top of the second primer layer 50 by the application of the water-based armor coat (See FIG. 2*c*). FIG. 2*c* reflects the thinness of the layer created by the non-ceramic components of the water-based armor coat after drying has occurred. The large size of the ceramic additive particles 56 allows the ceramic additive particles to protrude significantly above the dried non-ceramic components. The exposed ceramic additive particle surfaces create microbeads 57 in the surface of the armor coat layer 52.

FIG. 2*d* depicts a top coat layer 54 formed over the armor coat layer 52 by the addition of a water-based top coat. The top coat layer 54 covers the microbeads 57 in the armor coat layer 52 but, upon drying, the surface of the top coat layer 58 also contains microbead characteristics due to the underlying microbeads 57.

FIG. 2*e* depicts the condition of the gap area after neighboring hardwood boards have undergone seasonal expansion/contractions due to changed humidity levels. The weak bridge 53, FIG. 2*d* originally formed by application of the armor coat and top coat has broken, reference number 59, leaving the gap area 46 no longer sealed. Also, the water content of the panelization-inhibiting, primer in the gap area 43 slowly absorbs into the neighboring hardwood boards 42 leaving behind only a small amount of resins 61. Thus, the gap area 46 is substantially free of resins that act to rigidly affix the neighboring boards 42 to one another.

The durability of the finished floor resulting from the method disclosed herein is due to the concentration and particle size of the ceramic additives 56 in the armor coat layer 52. One can appreciate from FIGS. 2*d* and *e* that eventual wear of the top coat layer 54 will result in direct contact with the microscopic beads 57 comprised of the ceramic additives 56. Consequently, before wear can continue through the armor coat layer 52 and into the primer layers 48 and 50, the large ceramic additives 56 must be entirely worn through. This microscopic bead structure exhibits an extremely high degree of hardness and resistance to wear as shown by results of industry recognized abrasion resistance tests.

Figure 3:
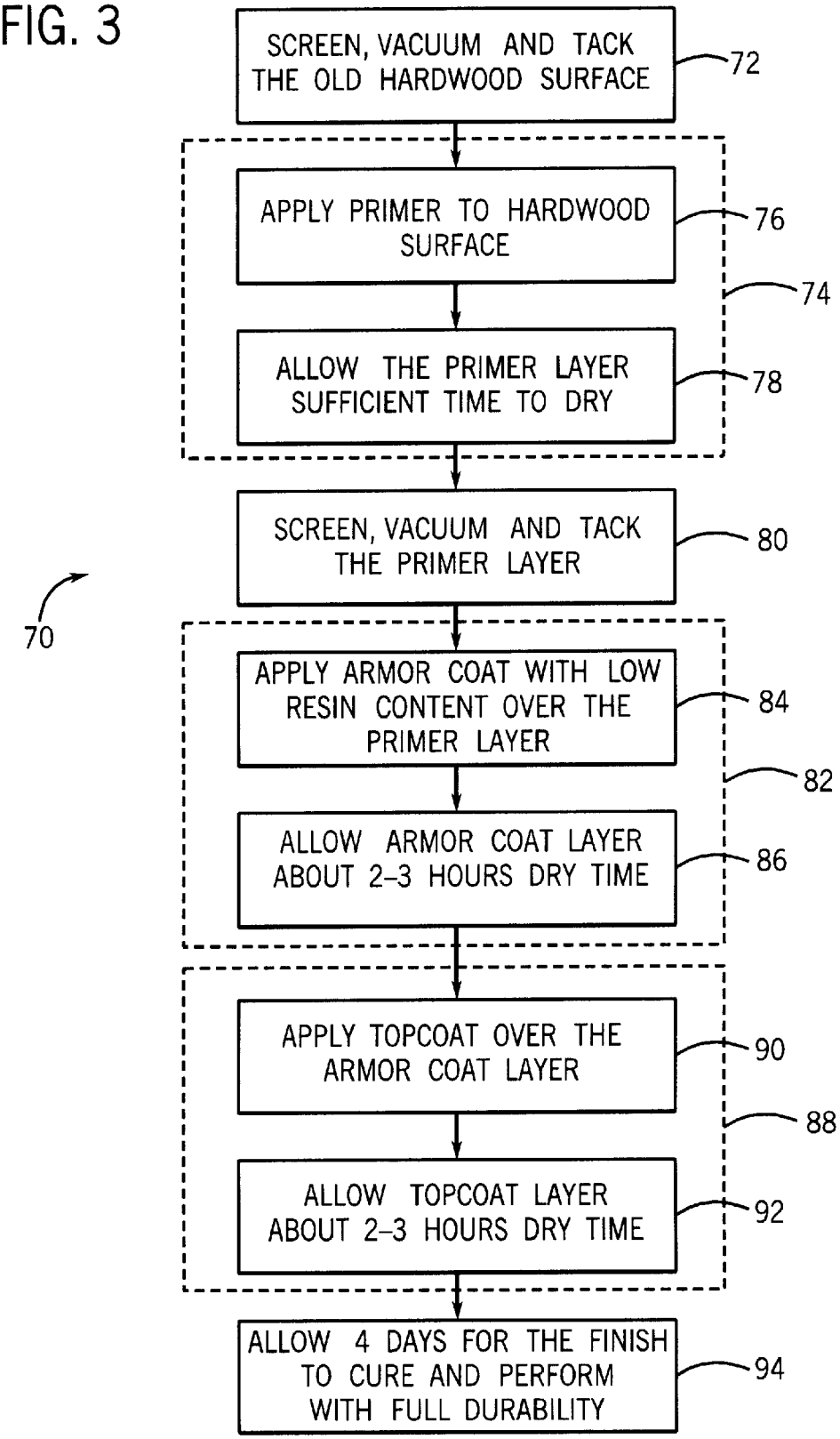
FIG. 3 is a flowchart illustrating the preferred process for refinishing an older hardwood surface in accordance with the invention.

Referring to FIG. 3, a method of refinishing older previously-finished hardwood floors 70 is shown. A previously finished hardwood surface is first sanded to remove substantially all preexisting finishes, block 72. The sanded surface is then thoroughly vacuumed and wiped down with a water dampened towel. A primer layer is then formed over the prepared hardwood surface, block 74. The preferred embodiment requires that only a single primer layer be applied to older hardwood surfaces, block 76. In contrast to the panelization-inhibiting primer previously described for newly constructed hardwood floors, the primer applied to older hardwood floors should be a conventional high solid content/high co-solvent concentration primer. This change in primer composition is due to the fact that any panelization problems will have already occurred with the hardwood flooring surface, and the application of panelization-inhibiting primers would have little or no beneficial effect on an older hardwood surface. After sufficient drying, block 78, the high solid content/high co-solvent concentration primer layer is then screened, vacuumed and tacked, block 80, in a similar fashion as that previously described for a newly constructed hardwood surface (see FIG. 1 and description thereof). Following screening, the finishing process continues in the same manner as that described for the newly constructed hardwood surface (i.e. steps depicted by blocks 84–94 in FIG. 3 or the same as steps depicted by blocks 30–40 in FIG. 1). As an alternative to sanding the previously finished floor to completely remove the old finish, it may be desirable in some circumstances to merely buff or screen the old finish. In such cases, it would not be necessary to apply primer.

It is recognized that other equivalents, alternatives, and modifications aside from those expressly stated, are possible and within the scope of the appended claims.

We claim:

1. A method of finishing a hardwood floor, comprising the steps of:

(a) applying a water-based primer directly to a screened hardwood surface to form a first primer layer, the water-based primer comprising a resin dispersion and at least one co-solvent, the resin dispersion and the at leat one co-solvent being present in amounts of about 15 percent to about 20 percent by weight of the primer of the resin dispersion and about 0.2 percent to about 1.5 percent by weight of the primer of the at least one co-solvent to reduce panelization of the hardwood floor, wherein the water-based primer does not include a separate crosslinker;

(b) reapplying the water-based primer after the first primer layer is formed and allowed to dry such that a second primer layer is subsequently formed over the first primer layer;

(c) screening the second primer layer after the second primer layer is sufficiently dry;

(d) applying over the second primer layer a water-based armor coat to form an armor coat layer, the water-based armor coat comprising a resin dispersion and also comprising at least one ceramic additive wherein at average particle size for the ceramic additive is in the range of about 15 microns up to about 35 microns, wherein after sufficient drying non-ceramic components of the armor coat form a substantially thin layer with respect to the ceramic additive such that the ceramic additive results in formation of microscopic beads in the thin layer created by the dried non-ceramic components of the armor coat; and (e) applying a water-based top coat such that a top coat layer is formed over the armor coat layer and the microscopic beads of the armor coat layer extend into top coat layer and further form microscopic beads on the surface of the top coat layer.

2. The method of claim 1 wherein the ceramic additive of the water-based armor coat is aluminum oxide.

3. The method of claim 1 wherein the water-based primer has a co-solvent concentration range from about 0.5 percent up to about 1.5 percent by weight.

4. The method of claim 1 wherein the water-based armor coat has a resin dispersion concentration range,from about 15 percent up to about 25 percent by weight.

5. The method of claim 1 wherein the water-based armor coat has a ceramic additive concentration range from about 15 percent up to about 35 percent by weight.

6. The method of claim 1 wherein the water-based armor coat further comprises a co-solvent with a concentration range from about 5.0 percent up to about 12.0 percent by weight.

7. The method of claim 1 wherein the water-based armor coat further comprises a fumed silica with a concentration range from about 0.2 percent up to about 2.0 percent by weight.

8. The method of claim 1 wherein the water-based top coat further comprises a resin dispersion with a concentration in the range of 34 percent up to about 42 percent by weight.

9. The method of claim 1 wherein the water-based top coat further comprises a fumed silica.

10. The method of claim 1 wherein the ceramic additive is aluminum oxide having a concentration range from about 15 percent up to about 35 percent by weight.

11. The method of claim 1 wherein the water-based primer includes about 1.0 percent by weight of the primer of the at least one co-solvent.

12. The method of claim 1 wherein the resin dispersion comprises a mixture of acrylic polymers and polyurethane polymers having 1 to 1.5 parts acrylic polymer to 1 part polyurethane polymer by weight.

13. The method of claim 1 wherein the step of applying the water-based primer includes the steps of:

a) spreading the water-based primer on the hardwood floor; and b) allowing the water-based primer to dry sufficiently at ambient temperature to form the first primer layer.

14. The method of claim 13 wherein the step of spreading the water-based primer on the hardwood floor comprises spreading the primer manually.

15. The method of claim 1 wherein the step of reapplying the water-based primer comprises the steps of:

a) spreading the water-based, primer over the first primer layer; and b) allowing the water-based primer to sufficiently dry at ambient temperature to form the second primer layer.

16. The method of claim 1 wherein the step of applying the water-based armor coat comprises the steps of:

a) spreading the water-based armor coat over the second primer layer; and b) allowing the water-based armor coat to dry sufficiently at ambient temperature to form the armor layer.

17. The method of claim 1 wherein the step of applying the water-based top coat comprises the steps of:

a) spreading the water-based top coat over the armor layer; and b) allowing the water-based top coat to dry sufficiently at ambient temperature to form the top coat layer.

18. The method of claim 1 wherein the water-based primer includes about 16 percent by weight of the primer of the resin dispersion.

* * * * *